US006029832A

United States Patent [19]

Bastian

[11] Patent Number: 6,029,832

[45] Date of Patent: Feb. 29, 2000

[54] FRAME ASSEMBLY

[75] Inventor: John M. Bastian, Manitowoc, Wis.

[73] Assignee: Fisher Hamilton Inc., Two Rivers, Wis.

[21] Appl. No.: 09/093,560

[22] Filed: Jun. 8, 1998

[51] Int. Cl.[7] ..... A47B 43/00

[52] U.S. Cl. ..... 211/189

[58] Field of Search ..... 211/189, 186, 211/187, 190, 191

[56] References Cited

U.S. PATENT DOCUMENTS

| | | | |
|---|---|---|---|
| 3,492,772 | 2/1970 | Bergman | 211/189 |
| 4,093,078 | 6/1978 | Radek | 211/189 |
| 4,884,702 | 12/1989 | Rekow | 211/189 |
| 5,607,070 | 3/1997 | Hellyer | 211/189 |

*Primary Examiner*—Alvin Chin-Shue
*Assistant Examiner*—Sarah Purol
*Attorney, Agent, or Firm*—Tilton, Fallon, Lungmus & Chestnut

[57] ABSTRACT

A free standing frame assembly for a furniture network includes first and second leg members spaced apart a predetermined distance with at lease one of the leg members having a bottom portion for engaging a supporting surface. One or more cross members extend between the leg members and connect them together; and one or more intermediate members lie between the leg members, releasably secured to the cross member.

11 Claims, 2 Drawing Sheets

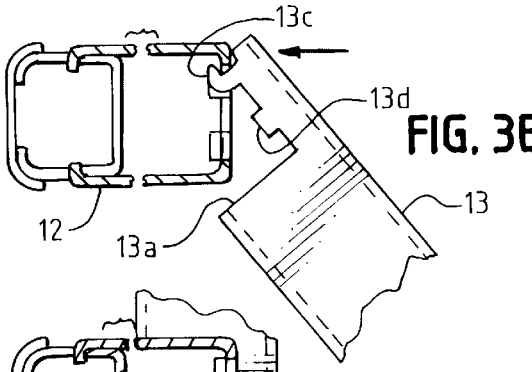
FIG. 3B
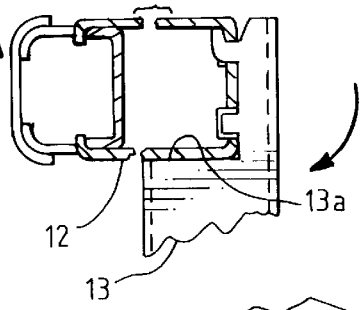
FIG. 3A
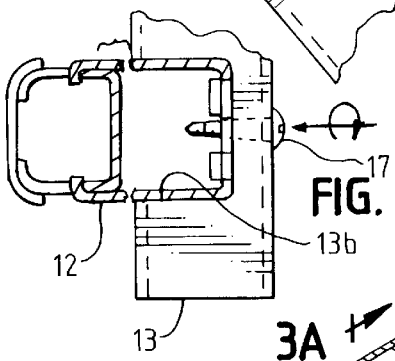
FIG. 4
FIG. 3
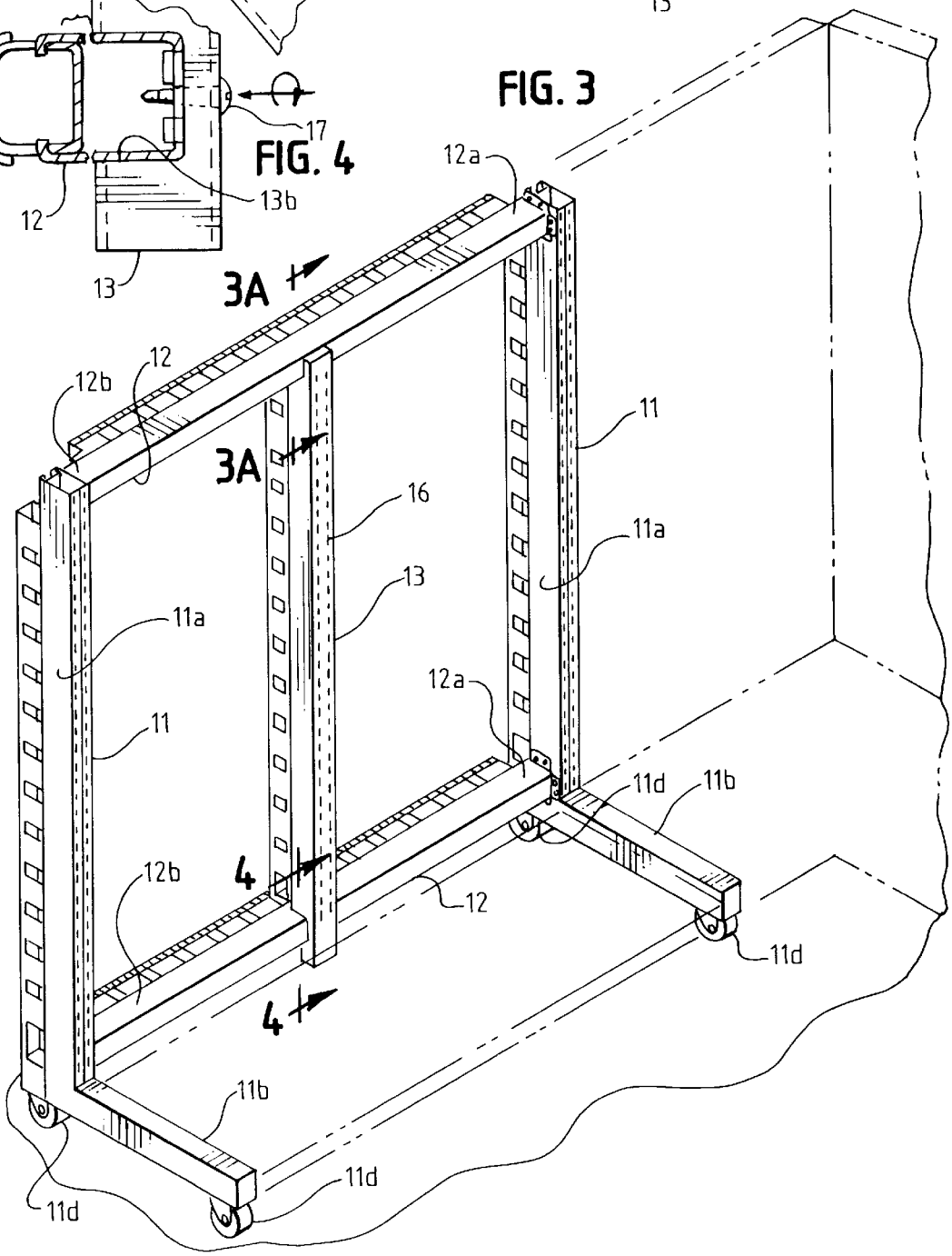

FRAME ASSEMBLY

BACKGROUND OF THE INVENTION

1. Field of the Invention

The present invention relates to a frame assembly for supporting a furniture network, and more particularly to a free standing frame assembly that includes leg members disposed a predetermined distance apart, one or more cross members for connecting the leg members together, and one or more moveable intermediate members that lie releasably secured to the cross member, provide support, and allow division of the span between the leg members.

2. Description of the Prior Art

The prior art includes a wide variety of office local area network systems and laboratory landscape systems in which prefabricated frame members, panels and furniture components disposed in predetermined positions define work stations and corridors within large, otherwise open spaces. The panels and furniture components lie releasably secured to a frame structure that dictates, to a great extent, the size of panels and furniture components that one may use in the system. The spacing of support members controls the size, and thus the variety of usable panels and furniture components.

It is desirable for a landscape system to easily assume different layout arrangements. The frame assembly of such a system should allow:

(a) quick and easy assembly;

(b) interchangeability of cross members to vary the width of the frame assembly;

(c) division of the spans in the frame assembly with support members to accommodate furniture components of varying width;

(d) structural stability for the system; and (e) easy routing of utilities.

The frame assembly of the present invention meets these requirements. It allows a variety of layout arrangements and provides flexibility in space utilization. It is a simple construction which minimizes the cost of fabrication and installation and provides structural stability for a landscape system.

SUMMARY OF THE INVENTION

In accordance with one embodiment of the present invention, a free standing frame assembly includes first and second leg members spaced apart a predetermined distance; one or more cross members disposed between the leg members and secured at opposite end portions to the leg members; and one or more intermediate members disposed between the leg members and releasably secured to the cross member.

In this embodiment, at least one of the leg members has a generally L-shaped configuration, including a bottom portion that engages a supporting surface and helps maintain the frame assembly in a free standing position. The first and second leg members, as well as the other parts of the frame assembly, also include means such as hook-receiving slots that allow furniture components and the like to hang from the frame members.

BRIEF DESCRIPTION OF THE DRAWINGS

For a more complete understanding of this invention, one should now refer to the embodiment illustrated in greater detail in the accompanying drawings and described below by way of an example of the invention. In the drawings:

FIG. 3 is a perspective view of a portion of the frame assembly shown in FIG. 1;

FIG. 3A is a sectional view taken along line 3A—A in FIG. 3, showing the connection between an intermediate member and a cross member;

FIG. 3B is the sectional view of FIG. 3A, showing the intermediate member and the cross member as one engages the other to form the connection shown in FIG. 3A; and FIG. 4 is a sectional view taken along line 4—4 in FIG. 3.

While the following disclosure describes the invention in connection with one embodiment and modifications of that embodiment, one should understand that the invention is not limited to this embodiment and modifications. Furthermore, one should understand that the drawings are not to scale and that graphic symbols, diagrammatic representatives, and fragmentary views, in part, illustrate the embodiment. In certain instances, the disclosure may not include details which are not necessary for an understanding of the present invention such as conventional details of fabrication and assembly.

DETAILED DESCRIPTION OF THE DRAWINGS

Figure 1:
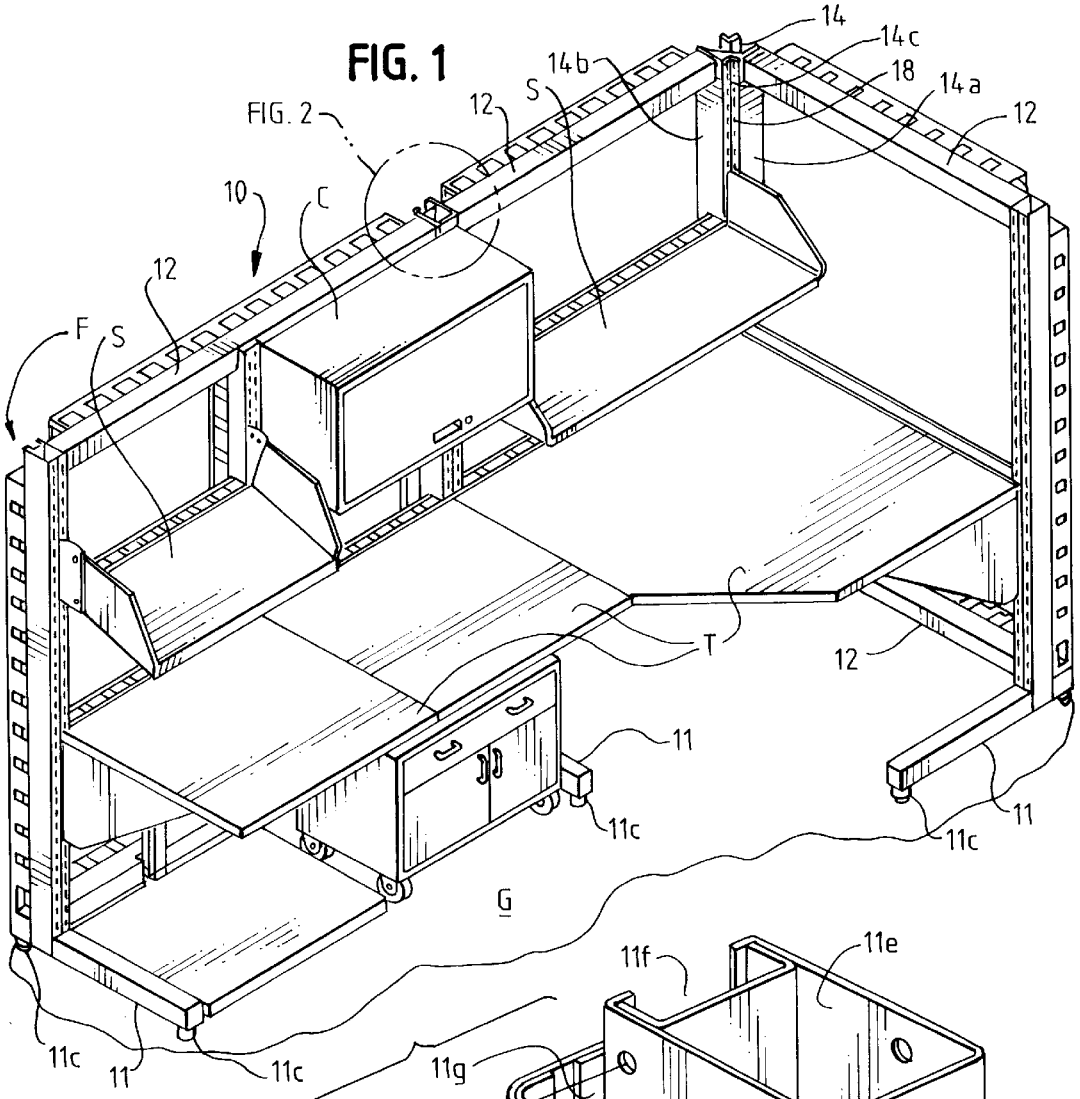
FIG. 1 is a perspective view of an office work station incorporating a frame assembly of the present invention.

Turning now to the drawings and referring specifically to FIGS. 1 and 3, the frame assembly F of the present invention shown at 10 generally includes leg members 11, cross members 12, an intermediate member 13, and a corner post 14. The members 11–14 are elongate members made out of sheet metal, plastic, or any other material of high strength and rigidity. They cooperate to support table tops T, shelves S, and a cabinet C and accordingly to define an office work station as shown in FIG. 1.

Figure 2:
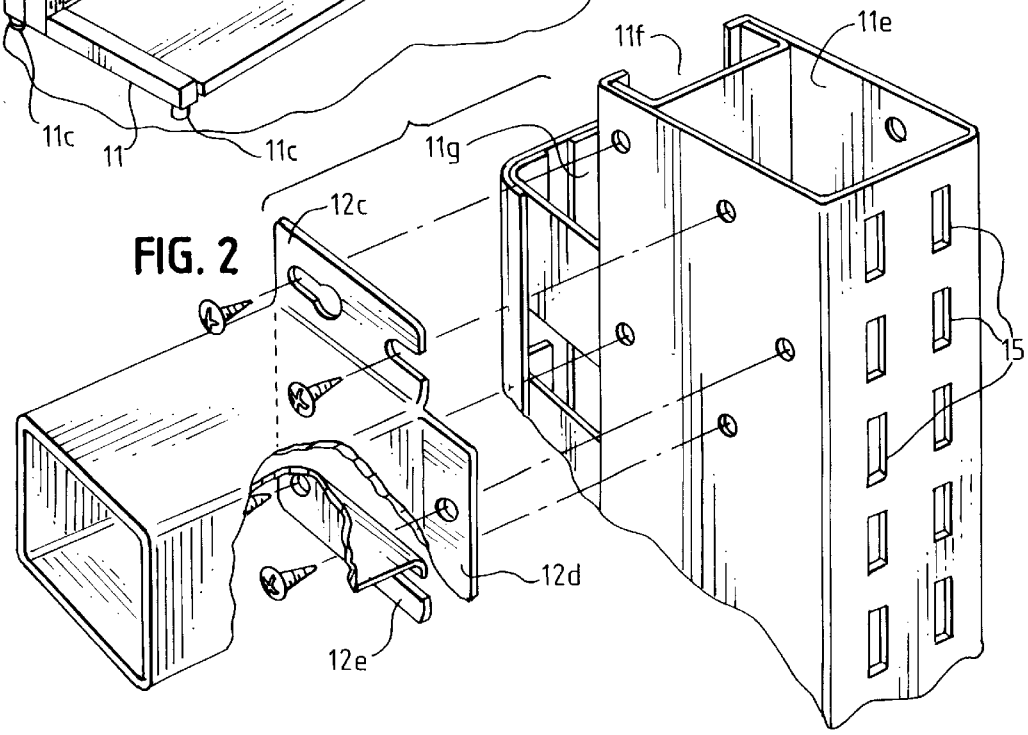
FIG. 2 is an enlarged and exploded perspective view of a connection between a leg member and a cross member.

The leg members 11 have an L-shaped configuration with elongate vertical portions 11*a* and horizontal portions 11*b* . The horizontal portions 11*b* include rests 11*c* (or alternatively, casters 11*d*) that engage a supporting surface G. In addition, each of the leg members 11 defines a plurality of openings 15 disposed in end to end relation (as shown in FIG. 2) a predetermined distance apart along the length of the vertical portion 11*a* of the leg member. Hook members (not shown) extend into these openings 15 to hang the various components of the work station. The leg members are hollow members with the vertical portion of each member defining a control bore 11*e* , an outer channel 11*f*, and a slotted-type passageway 11*g* through which utilities such as power lines may extend.

Similarly, the cross members 12 are hollow members that extend between the leg members 11 generally perpendicularly to adjacent leg members and connect the leg members together. They also support intermediate support members 13, as described below. Each of the cross members 12 includes opposite end portions 12*a* and 12*b*, with these end portions having flanges 12*c*, 12*d*, and 12*e* that project outwardly of the end portions and facilitate connection (by screws or other securing means) with a leg member 11 as shown in FIG. 2. The frame assembly may include two cross members 12 between adjacent leg members 11 as shown in FIG. 3; it may include more than two cross members; or it may include just one cross member.

The intermediate support members 13 subdivide the span between the leg members 11 to allow the installation of smaller furniture components (See FIGS. 3–4). They have a cross-sectional configuration similar to that of the vertical portions of the leg members; and they also define a plurality of openings 16 disposed in end to end relation along their length for receiving hook members that hang furniture components on the frame. The intermediate support members 13 lie releasably secured to the cross members 12. As shown in FIG. 3, the intermediate member 13 includes a first recess 13*a* that receives a cross member 12 at one end and a second recess 13*b* that receives another cross member 12 at an opposite end. It also includes a hook portion 13*c*and a protrusion 13*d* at the first recess 13*a* which help secure the top end of the intermediate member 13 to a top cross member 12 (See FIGS. 3A and 3B). A screw 17 or other similar means secures the bottom end of the intermediate member 13 to the bottom cross member 12 (See FIG. 4).

The frame assembly F shown in FIG. 1 also includes a corner post 14 that is a vertical member without a horizontal portion. It lies parallel to the leg and intermediate members and perpendicularly of the cross members. This post member includes two wing portions 14*a* and 14*b* that support end portions of the cross members and a middle portion 14*c* that includes hook receiving slots 18 for receiving and supporting the various furniture components.

While the above description and the drawings disclose and illustrate one embodiment and various modifications, one should understand, of course, that the invention is not limited to this embodiment and modifications. Those skilled in the art to which the invention pertains may make other modifications and other embodiments employing the principles of this invention, particularly upon considering the foregoing teachings. For example, while the vertical segments of the frame F lie parallel to each other and the cross members and horizontal segments lie parallel to each other and perpendicularly of the vertical segments, one may place these segments in other suitable arrangements. Therefore, by the appended claims, the applicant intends to cover any modifications and other embodiments as incorporate those features which constitute the essential features of this invention.

What is claimed is:

1. A free standing frame assembly for a furniture network, said assembly comprising:

first and second leg members spaced apart a predetermined distance, said leg members including bottom portions for engaging a supporting surface;

at least one cross member with opposite end portions, one end portion being secured to the first leg member and the opposite end portion being secured to the second leg member;

at least one intermediate member disposed between the first and second leg member, said intermediate member being repositionable on the cross member between the first and second leg members and including a hook portion that extends into an opening disposed between opposite ends of the cross member to releasably secure the intermediate member to the cross member.

2. The frame assembly of claim 1, further comprising another cross member with opposite end portions, one end portion being secured to the first leg member and the opposite end portion being secured to the second leg member.

3. The frame assembly of claim 2, wherein the first and second leg members lie in substantially parallel relation with each other and the cross members lie in substantially parallel relation with each other and in substantially perpendicular relation with the leg members.

4. The frame assembly of claim 3, wherein the first and second leg members and the intermediate member include hanging means for hanging furniture components on the assembly.

5. The frame assembly of claim 4, wherein the hanging means includes a plurality of slots formed into the leg members and the intermediate member.

6. The frame assembly of claim 3, wherein the leg members have a generally L-shaped configuration.

7. A free standing frame assembly for a furniture network, said assembly comprising:

first and second leg members spaced apart a predetermined distance, said leg members including bottom portions for engaging a supporting surface;

a plurality of cross members, each cross member including opposite end portions with one end portion being secured to the first leg member and the opposite end portion being secured to the second leg member;

at least one intermediate member disposed between the first and second leg member, said intermediate member being repositionable on the cross member between the first and second leg members and including a hook portion that extends into an opening disposed between opposite ends of the cross member to releasably secure the intermediate member to the cross member;

the first and second leg members lying in substantially parallel relation with each other and the cross members lying in substantially parallel relation with each other and in substantially perpendicular relation with the leg members.

8. The frame assembly of claim 7, wherein the first and second leg members and the intermediate member include hanging means for hanging furniture components on the assembly.

9. The frame assembly of claim 8, wherein the hanging means includes a plurality of slots formed into the leg members and the intermediate member.

10. The frame assembly of claim 7, wherein the leg members have a generally L-shaped configuration.

11. A free standing frame assembly for a furniture network, said assembly comprising:

first and second leg members spaced apart a predetermined distance, one of said first and second leg members including an elongate bottom portion for engaging a supporting surface;

at least one cross member with opposite end portions, one end portion being secured to the first leg member and the opposite end portion being secured to the second leg member;

at least one intermediate member disposed between the first and second leg member, said intermediate member being repositionable on the cross member between said first and second leg members and including a hook portion that extends into an opening disposed between opposite ends of the cross member to releasably secure the intermediate member to the cross member.

* * * * *